US006384536B1

(12) United States Patent
Yasui et al.

(10) Patent No.: US 6,384,536 B1
(45) Date of Patent: May 7, 2002

(54) CRT DISPLAY APPARATUS

(75) Inventors: Hironobu Yasui; Akinori Heishi, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/776,627

(22) Filed: Feb. 6, 2001

(30) Foreign Application Priority Data

Aug. 25, 2000 (JP) ..... 2000-255281

(51) Int. Cl.[7] ..... H01J 29/52
(52) U.S. Cl. ..... 315/3; 315/30
(58) Field of Search ..... 315/3, 30

(56) References Cited

U.S. PATENT DOCUMENTS 5,025,196 A * 6/1991 Suzuki et al. ..... 315/168

FOREIGN PATENT DOCUMENTS

JP A11224618 8/1999

* cited by examiner

*Primary Examiner*—David Vu

(57) ABSTRACT

A CRT display apparatus including a CRT having an electron gun is disclosed. The electron gun includes a cathode, a G1 electrode, a G2 electrode, and a G3 electrode disposed in that order for drawing electrons from the cathode. The electron gun further includes a modulating Gm electrode disposed between the G2 electrode and the G3 electrode. The CRT display apparatus is provided with a current measuring circuit measuring a current flowing through the Gm electrode and a controller for controlling a value of a voltage applied to the Gm electrode according to a value of the current measured by the current measuring circuit for the purpose of preventing the electron beam flowing from the electron gun to the screen of the CRT from becoming excessive.

3 Claims, 6 Drawing Sheets

CRT DISPLAY APPARATUS

FIELD OF THE INVENTION

The present invention relates to a display apparatus including a CRT.

BACKGROUND OF THE INVENTION

FIG. 9 shows a structure of a conventional CRT display apparatus. In the figure, there is shown a CRT 18, a cathode 2, a G1 electrode 3, a G2 electrode 4, a G3 electrode 6, an anode 7, a video circuit 9, a flyback transformer (FBT) 12, an anode current measuring circuit 13, a resistor 14, a capacitor 15, and a variable resistor 19. The G1 electrode 3, G2 electrode 4, and G3 electrode 6 are cylindrical-shaped electrodes disposed within an electron gun to draw electrons from the cathode 2 and converge them. Other focusing electrodes disposed after the G3 electrode are omitted from the drawing to simplify explanation.

The operation of the apparatus of FIG. 9 will now be explained. A video signal is amplified in the video circuit 9, and supplied to the cathode 2. A high tension produced by the FBT12 is applied to the anode 7. The G2 electrode 4 is applied with a voltage obtained by dividing the high tension by the resistor 19. The FBT12 is supplied with a current from the resistor 14 within the anode current measuring circuit 13, and the capacitor 15 is charged at this time. It is possible to determine the anode current from the value of a voltage drop caused by the current flowing through the resistor 14. The value of this voltage drop is supplied to the video circuit 9.

The high tension of about 25 kV applied to the anode 7 is obtained by stepping up horizontal flyback pulses produced by a horizontal deflection circuit (not shown) and rectifying them by the FBT 12. The voltage of about 700 to 1000V applied to the G2 electrode 4 is produced by dividing this high tension by the resistor 19. Since the current flowing through the G2 electrode 4 is very small, the resistor 19 for dividing the high tension has a resistance as much as about 100 Mohm. A screen adjustment (coarse cutoff adjustment) can be performed to change a black level by adjusting the voltage applied to the G2 electrode 4.

Such a CRT display apparatus is usually provided with an automatic contrast limiting (ACL) circuit (also called an automatic brightness limiting (ABL) circuit), in order to prevent an average electron beam flowing from the cathode to the screen from exceeding an allowable level. Since the anode current is in proportion to the current of an electron beam (referred to as a "beam current" hereinafter), it is possible to determine the value of the beam current by measuring the anode current flowing through the FBT 12. The measured value of the anode current is supplied to the ACL circuit. Various types of anode current measuring circuit can be used. In the apparatus of FIG. 9, the anode current is measured from the value of the voltage drop across the resistor 14 caused by the current flowing therethrough. The value of this voltage drop is supplied to the video circuit 9 which includes a preamplifier, an image-enhancement circuit, etc. When the anode current exceeds the allowable level, the video circuit 9 suppresses the amplitude of the video signal supplied to the cathode by reducing its amplification factor of the video signal. Consequently, the beam current is suppressed and the intensity is reduced.

On the other hand, the demand for improving resolution of CRT display apparatuses is growing in recent years. Japanese Unexamined Patent Publication No. 11-224618 discloses a-high intensity/resolution CRT (referred to as "Hi-Gm tube" hereinafter) that addresses such a demand. This Hi-Gm tube features a novel electron gun that has, in addition to the G1, G2 and G3 electrodes, an electrode called "Gm electrode" disposed between the G2 electrode and the G3 electrode for modulating the electron beam.

FIG. 10 shows a structure of such an electron gun used for the Hi-Gm tube. In this figure, 20 denotes a G1 electrode, 21 denotes a G2 electrode, 23 denotes a cathode, 24 denotes an electron-emitting substance formed on the surface of the cathode 23, and 25 denotes a Gm electrode. This electron gun has, for the part following the G3 electrode where other focusing electrodes are disposed, the same structure as the conventional electron gun.

FIG. 11 is a graph showing potential distribution near the cathode within the electron gun of the Hi-Gm tube. In this graph, the horizontal axis represents the distance (mm) from the cathode surface, the vertical axis represents the potential (V), and the curve 26 shows the potential distribution symmetrical with the axis of revolution near the cathode. Furthermore, the arrow 27 shows the range within which the Gm electrode 25 exists, which is about 0.5 mm from the cathode surface.

The potential of the Gm electrode 25 is set to about 80VDC, so there is a position 28 within the range 27, at which the level of the spatial, potential is minimum. If the potential of the cathode 23 shown by the dashed line is lower than the potential at this position 28, electrons pass through the position 28 and flow towards the screen. If not, electrons do not flow towards the screen since they cannot pass through the position 28.

As seen from this graph, between the cathode 23 and the position 28, electrons always exist abundantly, and the slope of the potential after the Gm electrode 25 is of the order of $10^6$ (V/m). Compared with the potential slope between the cathode and the G1 electrode, it is greater by an order of magnitude. Therefore, after electrons pass through the Gm electrode 25, most of them can move towards the screen without being affected by spatial charges, so the intensity of the electron beam flowing to the screen is determined by the quantity of the electrons that pass through the position 28 at which the spatial potential is minimum.

For this reason, variation of the intensity of the electron beam in the Hi-Gm tube when the cathode potential is varied by a certain value in the Hi-Gm tube is about twice as much as that in the conventional CRT. That is, the variation of the cathode potential required to vary the intensity of the electron beam by a certain value is less than half the variation required in the conventional CRT. In other words, with the Hi-Gm tube, the variation of the intensity of the electron beam can be doubled for the same variation of the cathode potential. Consequently, with the Hi-Gm tube, it is possible to easily adapt to video signals of high frequency, and therefore to provide a display apparatus of high intensity and high resolution.

FIG. 12 is a graph showing how the cathode current, the beam current, the G2 electrode current, and the Gm electrode current vary when the cathode voltage varies. In this graph, reference numeral 29 denotes the cathode current, 30 denotes the beam current, 31 denotes the G2 electrode current, and 32 denotes the Gm electrode current. This graph holds while the G2 electrode voltage is 500V, and the Gm electrode voltage is 80V. From this graph, it is apparent that as the cathode voltage decreases, the beam current increases and thereby the brightness of the screen is enhanced, and that the beam current starts to flow towards the screen when the cathode voltage falls below 80V, since the voltage applied to the Gm electrode is 80V. Furthermore, it is also apparent form this graph that the Gm electrode current and the G2 electrode current increase as the beam current increases.

OBJECT AND SUMMARY OF THE INVENTION

In the display apparatus using the above-described Hi-Gm tube, since the variation of the beam current can be more than twice the variation in the case of a CRT display apparatus using the conventional electron gun for the same variation of the cathode voltage, the possibility of the beam current becoming excessive is higher for that. If the excessive beam current continues to flow, emission failure etc. can occur which leads to shorten a CRT lifespan. Therefore, in the display apparatus using the Hi-Gm tube, the control over the beam current is more important than ever before. An object of the present invention is to provide a CRT display apparatus provided with a novel structure for preventing its beam current from becoming excessive in consideration of the above-described characteristic of the Hi-Gm tube.

The object is achieved by a CRT display apparatus including a CRT having an electron gun, the electron gun including:

a cathode;

a G1 electrode, a G2 electrode, and a G3 electrode disposed in that order for drawing electrons form the cathode; and a modulating Gm electrode disposed between the G2 electrode and the G3 electrode;

the CRT display apparatus further including:

a current measuring circuit for measuring one of a current flowing through the Gm electrode, a current flowing through the G2 electrode and a current flowing through an anode of the CRT; and a controller for controlling a value of a voltage applied to the Gm electrode according to a value of the current measured by the current measuring circuit.

The object is also achieved by a CRT display apparatus including a CRT having an electron gun, the electron gun including:

a cathode;

a G1 electrode, a G2 electrode, and a G3 electrode disposed in that order for drawing electrons form the cathode; and a modulating Gm electrode disposed between the G2 electrode and the G3 electrode;

the CRT display apparatus further including:

a current measuring circuit for measuring one of a current flowing through the Gm electrode, a current flowing through the G2 electrode and a current flowing through an anode of the CRT; and a controller for controlling a value of a voltage applied to the G2 electrode according to a value of the current measured by the current measuring circuit.

The object is also achieved by a CRT display apparatus including a video circuit and a CRT having an electron gun, the electron gun including:

a cathode;

a G1 electrode, a G2 electrode, and a G3 electrode disposed in that order for drawing electrons form the cathode; and a modulating Gm electrode disposed between the G2 electrode and the G3 electrode;

the video circuit supplying a video signal having an amplitude determined by a control signal to the cathode, the CRT display apparatus further including:

a current measuring circuit for measuring a value of one of a current flowing through the Gm electrode, a current flowing through the G2 electrode and a current flowing through an anode of the CRT, and supplying the measured value to the video circuit as the control signal.

BRIEF DESCRIPTION OF THE DRAWINGS

Embodiments of the invention will now be described by way of example and with reference to the accompanying drawings in which.

DESCRIPTION OF THE PREFERRED EMBODIMENTS

Figure 1:
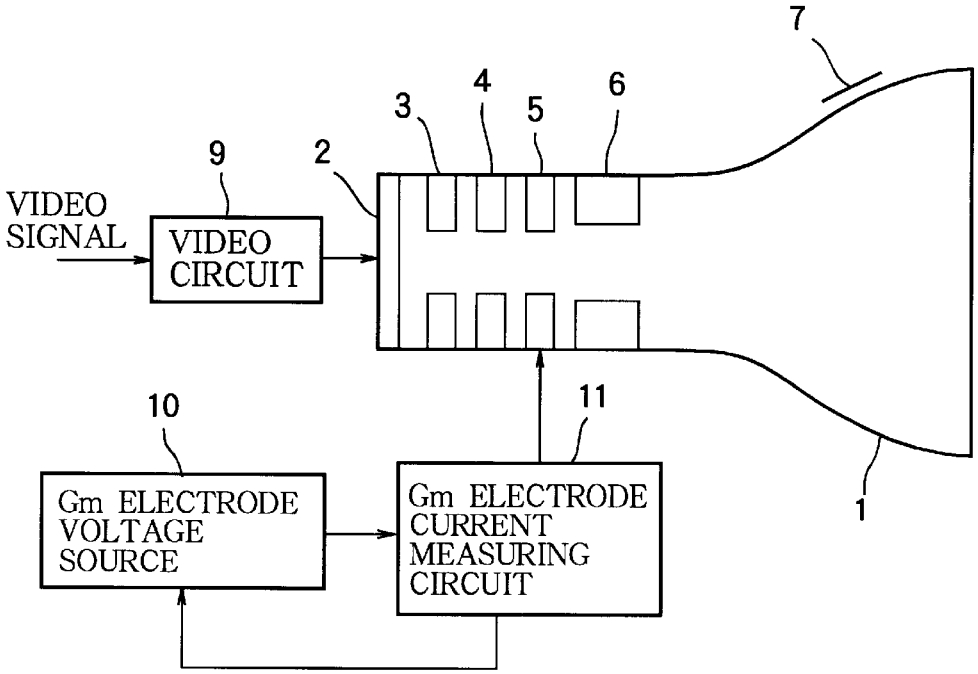
FIG. 1 is a block diagram showing a structure of a first example of the CRT display apparatus according to the invention.

FIG. 1 is a block diagram showing a structure of a first example of the CRT display apparatus according to the invention. In the figure, there is shown a Hi-Gm tube 1, a cathode 2, a G1 electrode 3, a G2 electrode 4, a Gm electrode 5, a G3 electrode 6, an anode 7, a video circuit 9, a Gm electrode 10, and a Gm electrode current measuring circuit 11. Since the structure of the apparatus is the same as that of the conventional apparatus for the part following the G3 electrode, illustration of that part is omitted to simplify the explanation.

A video signal is inverted and amplified in the video circuit 9, and thereafter supplied to the cathode 2. The Gm electrode voltage source 10 produces a voltage to be applied to the Gm electrode 5. The Gm electrode current measuring circuit 11 measures a current flowing through the Gm electrode 5, and supplies the measured value to the Gm electrode voltage source 10. In the first example, the G1 electrode 3 is applied with 0v, the G2 electrode 4 is applied with 500V, the G3 electrode 6 is applied with 5.5 KV, the Gm electrode 5 is applied with 80 V, and the anode 6 is applied with the high tension of 25 KV.

Figure 12:
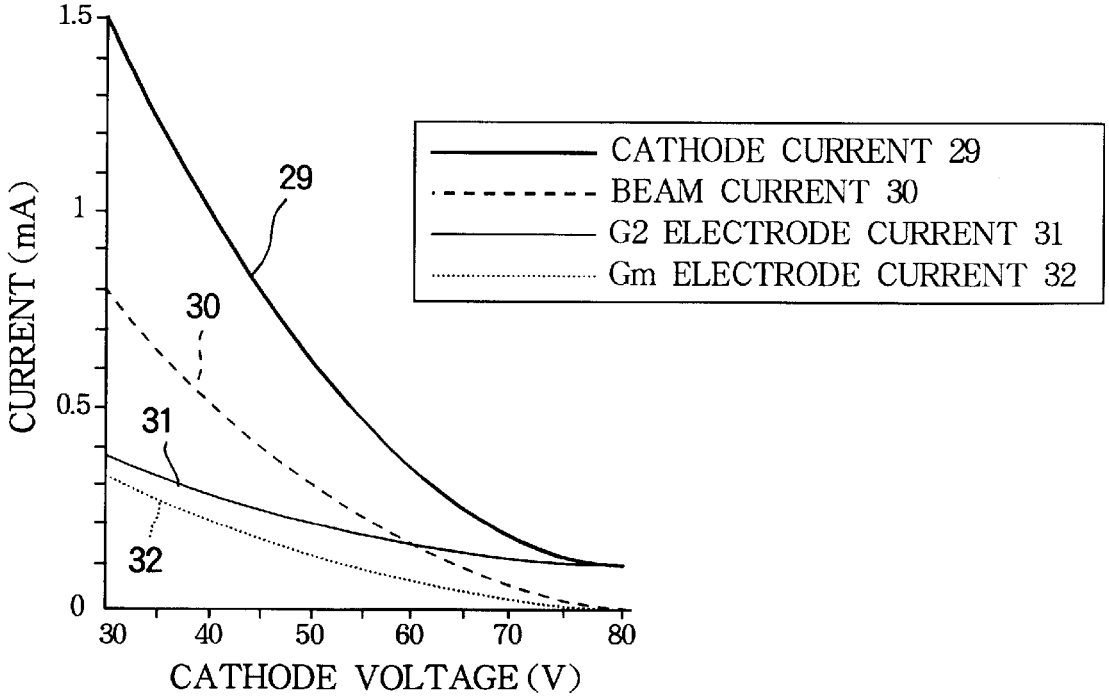
FIG. 12 PRIOR ART
FIG. 12 is a graph showing a relationship between a cathode voltage and currents flowing through electrodes within the Hi-Gm tube.

As has been explained with reference to FIG. 12, the beam current and the Gm electrode current are in a direct proportional relationship. The first example utilizes this characteristic to determine the beam current by measuring the Gm electrode current.

If the measured value of the Gm electrode current exceeds an allowable level, the Gm electrode voltage source 10 reduces its output voltage, that is, reduces the voltage applied to the Gm electrode 5 depending on the measured value. The voltage applied to the Gm electrode 5 defines a threshold point with respect to the cathode voltage at which the screen starts to illuminate. When the cathode voltage falls below the Gm electrode voltage, the electron beam starts to flow to the screen, causing the screen to illuminate. Accordingly, if the Gm electrode voltage is lowered, the threshold point with respect to the cathode voltage at which the screen starts to illuminate is lowered, thereby enabling suppressing the beam current.

With the above-described first example, since the beam current is determined not by measuring the anode current, but by measuring the current flowing from the Gm electrode voltage source 10, whose output voltage is below 100V and whose output current is smaller than 1 mA, to the Gm electrode 5, it is possible to determine the beam current easily with a simple circuit. There are various ways for measuring the current flowing through the Gm electrode. For example, it can be measured as a voltage value from a voltage drop across a resistor connected to the Gm electrode in series.

Figure 2:
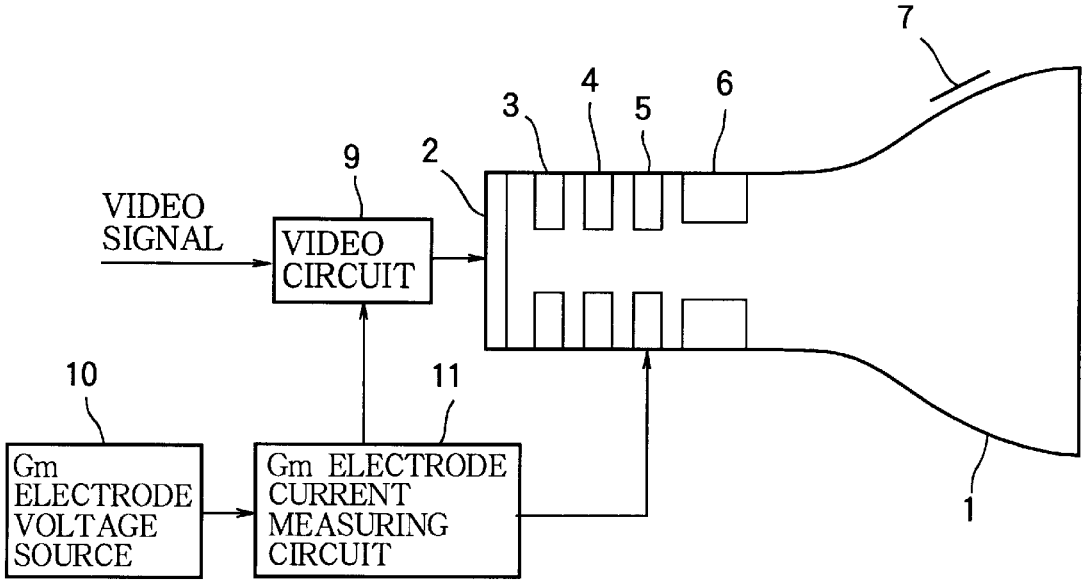
FIG. 2 is a block diagram showing a structure of a second example of the CRT display apparatus according to the invention.

FIG. 2 is a block diagram showing a structure of a second example of the CRT display apparatus according to the invention. In FIG. 2, reference numerals identical to those in FIG. 1 represent the same elements. In the second example, as in the case of the first example, the beam current is determined by measuring the Gm electrode current utilizing the characteristic that the beam current and the Gm electrode current is in a direct proportional relationship. An image enhancement-circuit such as a preamplifier or a video chromatic jungle (VCJ) within the video circuit is usually provided with a control input terminal for performing a contrast adjustment etc. The second example differs from the first example in that the Gm electrode current measuring circuit 11 supplies its measured value to this control input terminal of the video circuit 9 and not to the Gm electrode voltage source 10.

If the measured value of the Gm electrode current exceeds an allowable level, the video circuit 9 reduces its gain according to the measured value to reduce the amplitude of a video signal supplied to the cathode, thereby lowering intensity. Thus, the beam current is suppressed. If the Gm electrode current measuring circuit 11 is provided with an integrator circuit at its output, the average beam current is suppressed but its high frequency components corresponding to small bright areas on the screen are not suppressed much, so it is possible to obtain a sufficient intensity peak, whereby an enhanced image can be obtained especially in the case of displaying a motion video on a TV screen etc.

In the conventional CRT display apparatus or TV, what is supplied to the contrast control circuit within the video circuit is the measured value of the anode current, while, in the second example, it is the measured value of the Gm electrode current. As described above, in the second example, since the contrast control circuit usually provided within the video circuit is used to control the beam current, the cost of manufacturing the apparatus can be reduced. Furthermore, as in the case of the first example, since the beam current is determined not by measuring the anode current, but by measuring the current flowing from the Gm electrode voltage source 10, whose output voltage is below 100V and whose output current is smaller than 1 mA, to the Gm electrode 5, it is possible to determine the beam current easily with a simple circuit.

Figure 3:
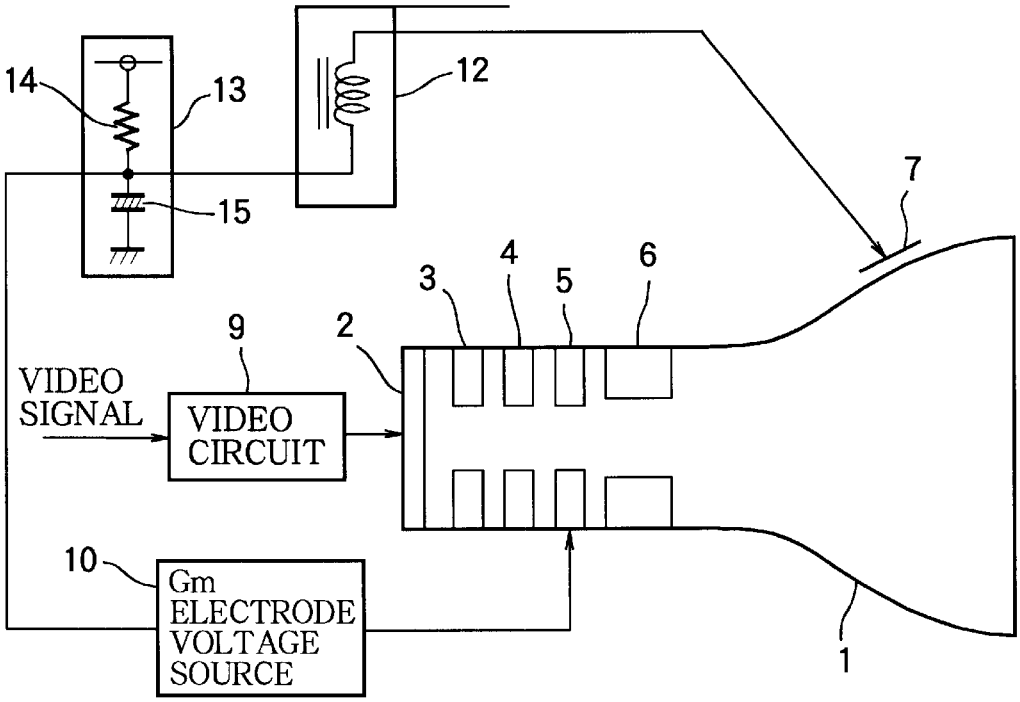
FIG. 3 is a block diagram showing a structure of a third example of the CRT display apparatus according to the invention.
Figure 9:
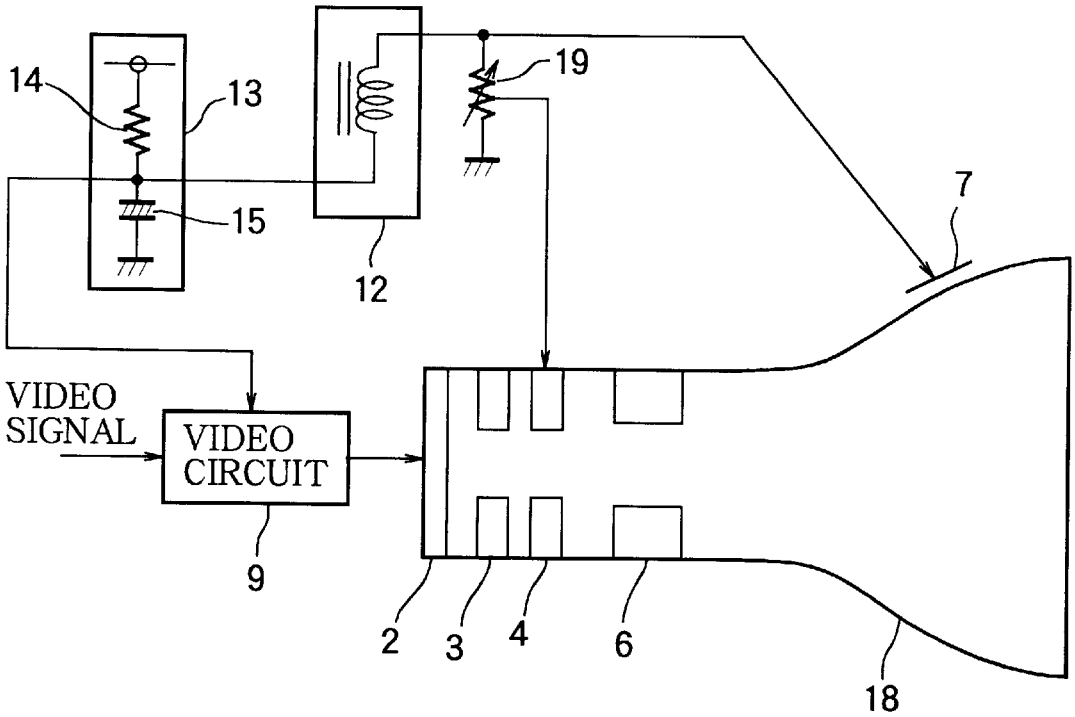
FIG.9 PRIOR ART
FIG. 9 is a block diagram showing a structure of a conventional CRT display apparatus.
Figure 10:
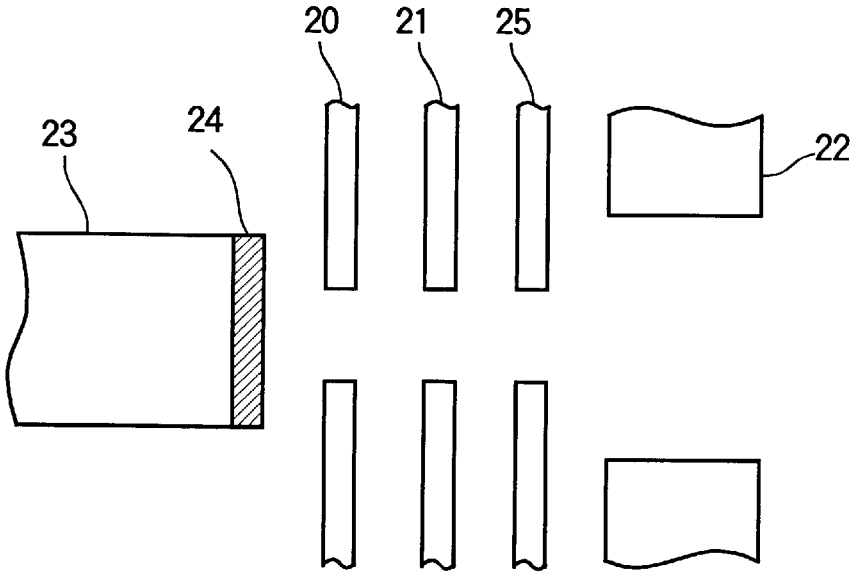
FIG.10 PRIOR ART
FIG. 10 is an explanatory view of a structure of an electron gun used for a Hi-Gm tube.
Figure 11:
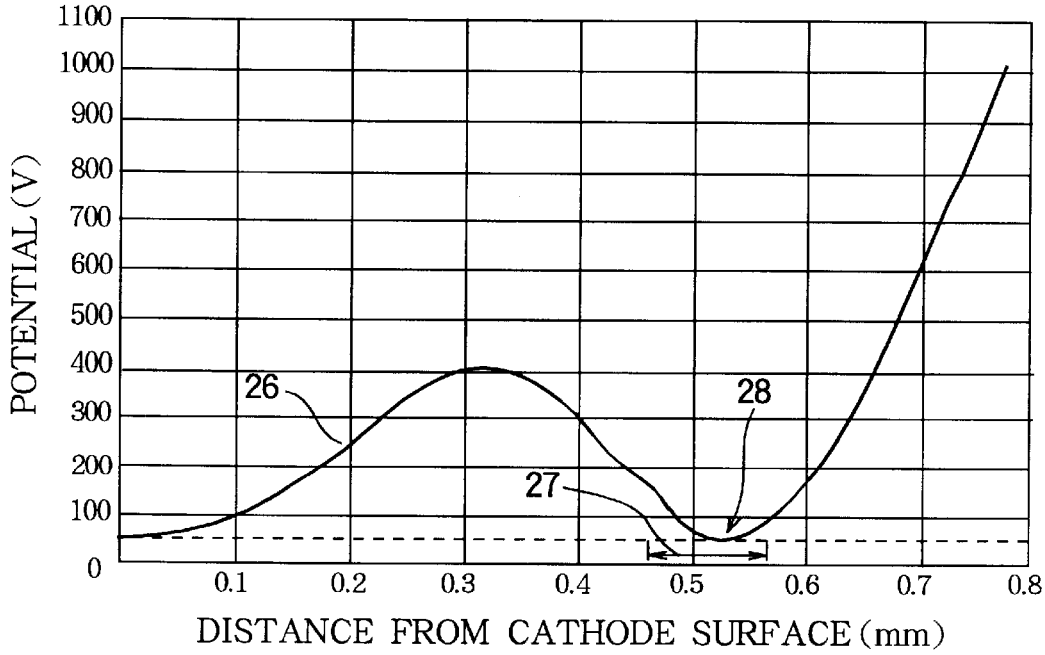
FIG. 11 PRIOR ART
FIG. 11 is a graph showing potential distribution near the cathode of the electron gun within the Hi-Gm tube.

FIG. 3 is a block diagram showing a structure of a third example of the CRT display apparatus according to the invention. In FIG. 3, reference numerals identical to those in FIGS. 1 and 2 represent the same elements. The third example differs from the first example in that instead of the Gm electrode current measuring circuit 11, the anode current measuring circuit 13 which has been described with reference to FIG. 9 is provided, and this anode current measuring circuit 13 supplies its measured value to the Gm electrode voltage source 10.

In the Hi-Gm, the anode current increases as the beam current a increases. The third example is arranged to measure the anode current and control the output voltage of the Gm electrode voltage source 10 depending on the measured value to prevent the beam current from becoming excessive. As already explained above, it is possible to determine the beam current by measuring the anode current from the voltage drop caused by the current flowing through the resistor 14 within the anode current measuring circuit 13.

If the measured value of the anode current exceeds an allowable level, the Gm electrode voltage source 10 reduces its output voltage, i.e., reduces the voltage applied to the Gm electrode 5, according to the measured value. As already described above, the voltage of the Gm electrode 5 defines a threshold point with respect to the cathode voltage at which the screen starts to illuminate. When the cathode voltage falls below the voltage of the Gm electrode 5, the electron beam starts to flow to the screen, causing the screen to illuminate. Accordingly, when the Gm electrode voltage is lowered, the threshold point with respect to the cathode voltage at which the screen starts to illuminate is lowered, thereby enabling suppressing the beam current. Thus, it is possible to prevent the beam current from becoming excessive by controlling the voltage applied to the Gm electrode according to the measured value of the anode current. Measuring the anode current is well known as one of the techniques of measuring the beam current in a CRT display apparatus, and introducing such a technique can be done without any difficulty.

Figure 4:
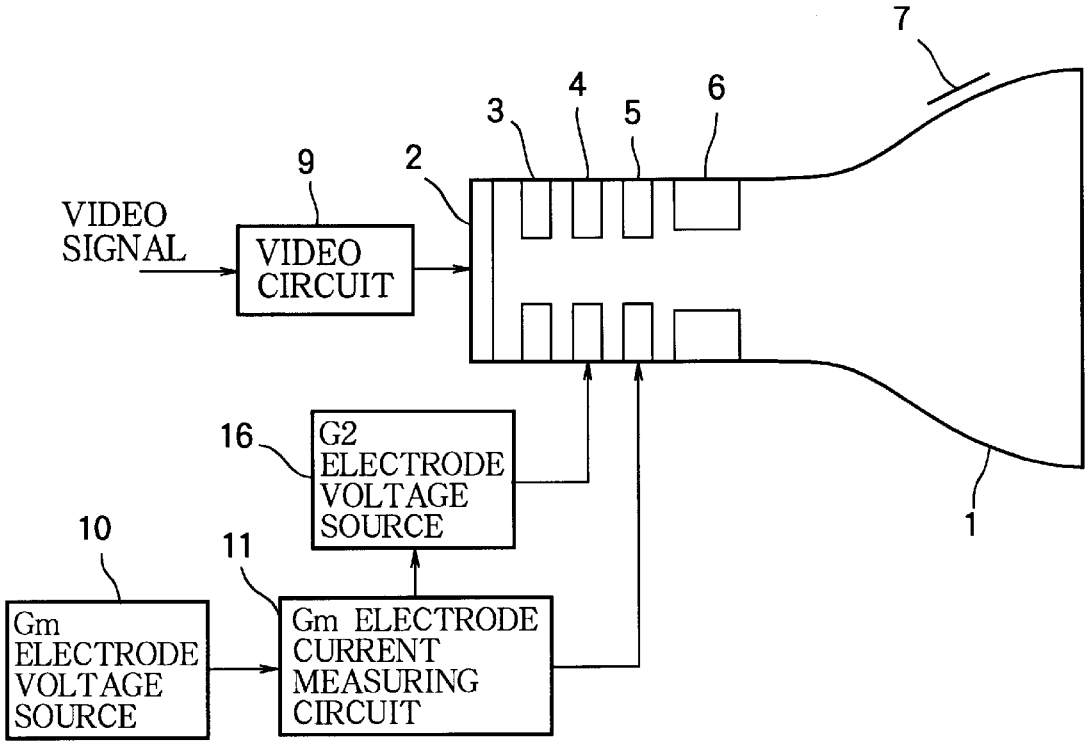
FIG. 4 is a block diagram showing a structure of a fourth example of the CRT display apparatus according to the invention.

FIG. 4 is a block diagram showing a structure of a fourth example of the CRT display apparatus according to the invention. In FIG. 4, reference numerals identical to those in FIGS. 1 to 3 represent the same elements. The fourth example differs from the first example in that the Gm electrode current measuring circuit 11 supplies its measured value to the G2 electrode voltage source 16 and not to the Gm electrode voltage source 10. The G2 electrode voltage source 16 produces a voltage to be applied to the G2 electrode 4, and is capable of varying its output voltage depending on the value of the current measured by the Gm electrode current measuring circuit 11.

As has been explained with reference to FIG. 12, in the Hi-Gm tube, since the Gm electrode current increases as the beam current increases, it is possible to determine the beam current by measuring the Gm electrode current.

In a display apparatus having the conventional CRT, a coarse cutoff adjustment (called "screen adjustment") to a threshold point with respect to the cathode voltage at which the screen starts to illuminate is performed by adjusting the voltage applied to the G2 electrode, while, a normal cutoff adjustment is performed by adjusting the cathode bias voltage. In the conventional CRT, when the G2 electrode voltage is lowered, potential difference relative to the cathode is lowered and the beam current can be reduced as a result. However, the black level falls concurrently. In the Hi-Gm tube as well, when the G2 electrode voltage is lowered, potential difference relative to the cathode is lowered and the beam current is reduced. In contrast to the case of the conventional CRT, in the case of the Hi-Gm tube, since the threshold point at which the screen starts to illuminate is determined by the voltage applied to the Gm electrode, the black level remains unchanged as long as the drop of the G2 electrode voltage is not so large. Accordingly, with the Hi-Gm tube, it is possible to suppress the beam current by lowering the G2 electrode voltage without changing the black level.

Thus, in the fourth example, if the measured value of the Gm electrode current exceeds an allowable level, the G2 electrode voltage source 16 reduces its output voltage, i.e., the voltage applied to the G2 electrode 4 according to the measured value. This makes it possible to prevent the beam current from becoming excessive without changing the black level.

Figure 5:
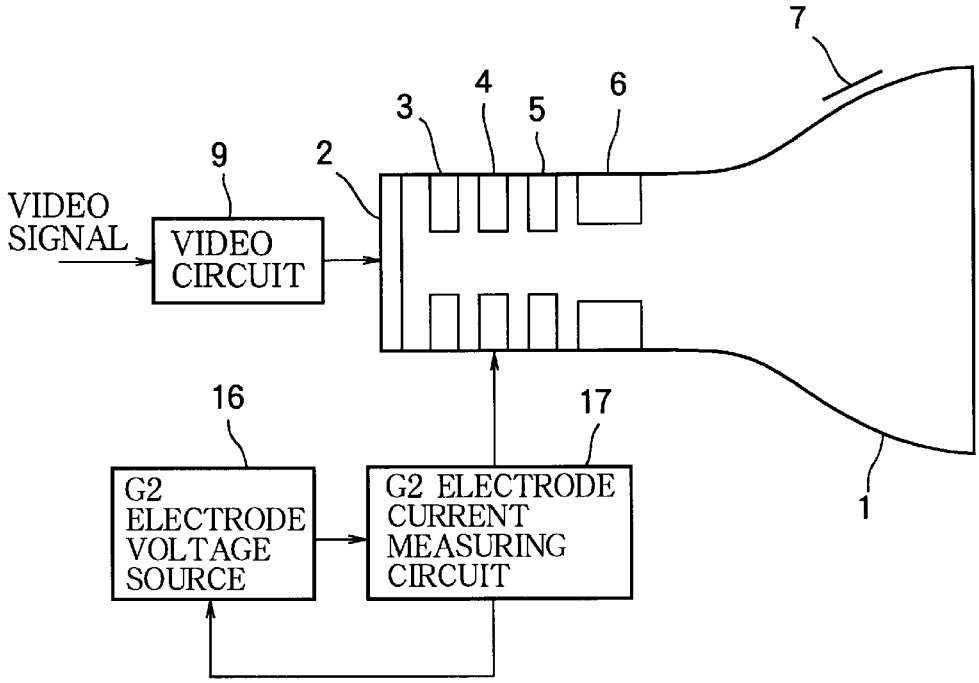
FIG. 5 is a block diagram showing a structure of a fifth example of the CRT display apparatus according to the invention.

FIG. 5 is a block diagram showing a structure of a fifth example of the CRT display apparatus according to the invention. In FIG. 5, reference numerals identical to those in FIGS. 1 to 4 represent the same elements. In FIG. 5, reference numeral 17 denotes a G2 electrode current measuring circuit connected to the G2 electrode voltage source 16 to measure a current flowing through the G2 electrode 4. The output of the G2 electrode current measuring circuit 17 is supplied to the G2 electrode voltage source 16. The G2 electrode voltage source 16 is arranged to vary its output voltage according to the current measured by the G2 electrode current measuring circuit 17.

As has been explained with reference to FIG. 12, in the Hi-Gm tube, as the cathode voltage decreases, the G2 electrode current increases along with the beam current. In the fifth example, the beam current is determined by measuring the G2 electrode current utilizing this characteristic. That is, in the fifth example, if the measured value of the G2 electrode current exceeds an allowable level, the G2 electrode voltage source 16 reduces its output voltage, i.e., the voltage applied to the G2 electrode 4 according to the measured value.

As has been explained with respect to the fourth example, in the Hi-Gm tube, the beam current can be reduced by lowering the G2 electrode voltage, and the black level remains unchanged as long as the drop of the G2 electrode voltage is not so large. Accordingly, it is possible to suppress the beam current by lowering the voltage applied to the G2 electrode 4 without changing the black level.

Figure 6:
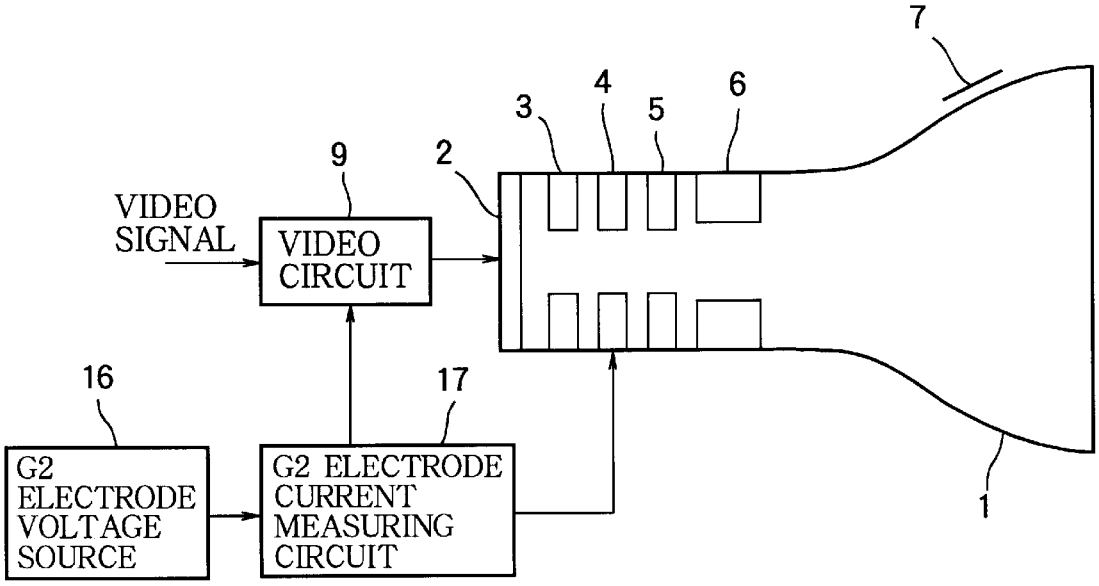
FIG. 6 is a block diagram showing a structure of a sixth example of the CRT display apparatus according to the invention.

FIG. 6 is a block diagram showing a structure of a sixth example of the CRT display apparatus according to the invention. In FIG. 6, reference numerals identical to those in FIGS. 1 to 5 represent the same elements. The sixth example differs from the fifth example in that the output of the G2 electrode current measuring circuit 17 is supplied to the control input terminal of the video circuit 9 and not to the G2 electrode voltage source 16.

In the sixth example as well as the fifth example, the beam current is determined by measuring the G2 electrode current utilizing the characteristic that the G2 electrode current increases along with the beam current as the cathode voltage decreases.

If the measured value of the G2 electrode current exceeds an allowable level, the video circuit 9 reduces its gain according to the measured value to reduce the amplitude of a video signal supplied to the cathode, thereby reducing the intensity. As a result, the beam current is suppressed. If the G2 electrode current measuring circuit 17 is provided with an integrator circuit at its output, since the average beam current is suppressed but its high frequency components corresponding to small bright areas on the screen are not suppressed much, so it is possible to obtain a sufficient intensity peak, whereby an enhanced image can be obtained especially in the case of displaying a motion video on a TV screen etc.

Figure 7:
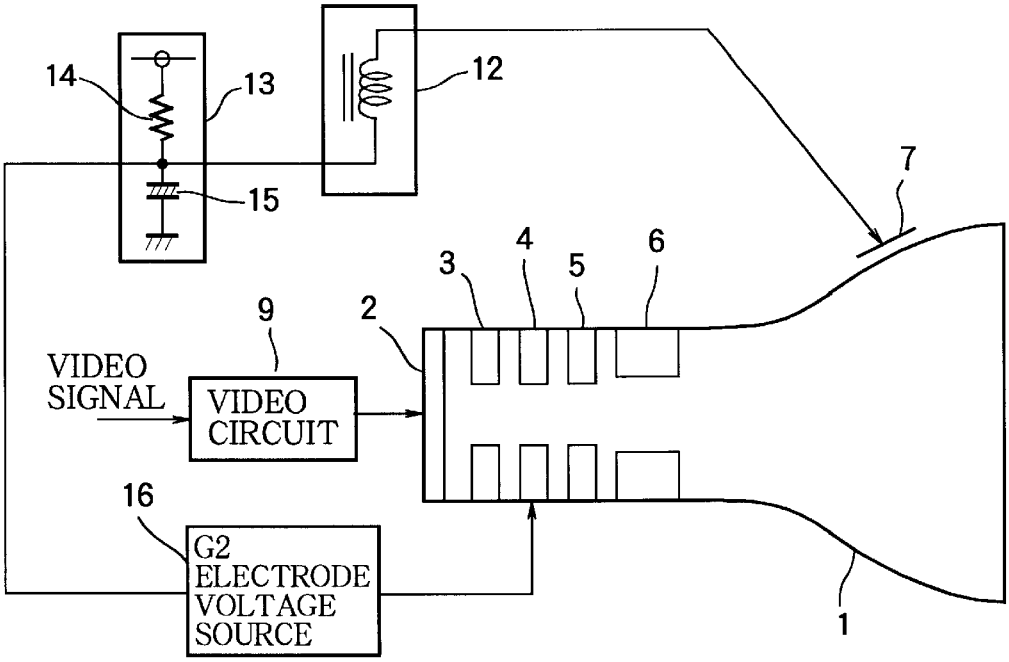
FIG. 7 is a block diagram showing a structure of a seventh example of the CRT display apparatus according to the invention.

FIG. 7 is a block diagram showing a structure of a seventh example of the CRT display apparatus according to the invention. In FIG. 7, reference numerals identical to those in FIGS. 1 to 6 represent the same elements. The seventh example as well as the third example is arranged to determine the beam current by measuring the anode current utilizing the characteristic that the anode current increases as the beam current increases in the Hi-Gm tube, however, it differs from the third example in that the output of the anode current measuring circuit 13 is supplied to the G2 electrode voltage source 16 and not to the Gm electrode voltage source 10.

If the measured value of the anode current exceeds an allowable level, the G2 electrode voltage source 16 reduces its output voltage, i.e., the voltage applied to the G2 electrode 4, according to the measured value. As has been described with respect to the fourth example, in the Hi-Gm tube, the beam current can be reduced by lowering the G2 electrode voltage, and the black level remains unchanged as long as the drop of the G2 electrode voltage is not so large. Accordingly, with the Hi-Gm tube, it is possible to suppress the beam current by lowering the voltage applied to the G2 electrode 4 without changing the black level.

Figure 8:
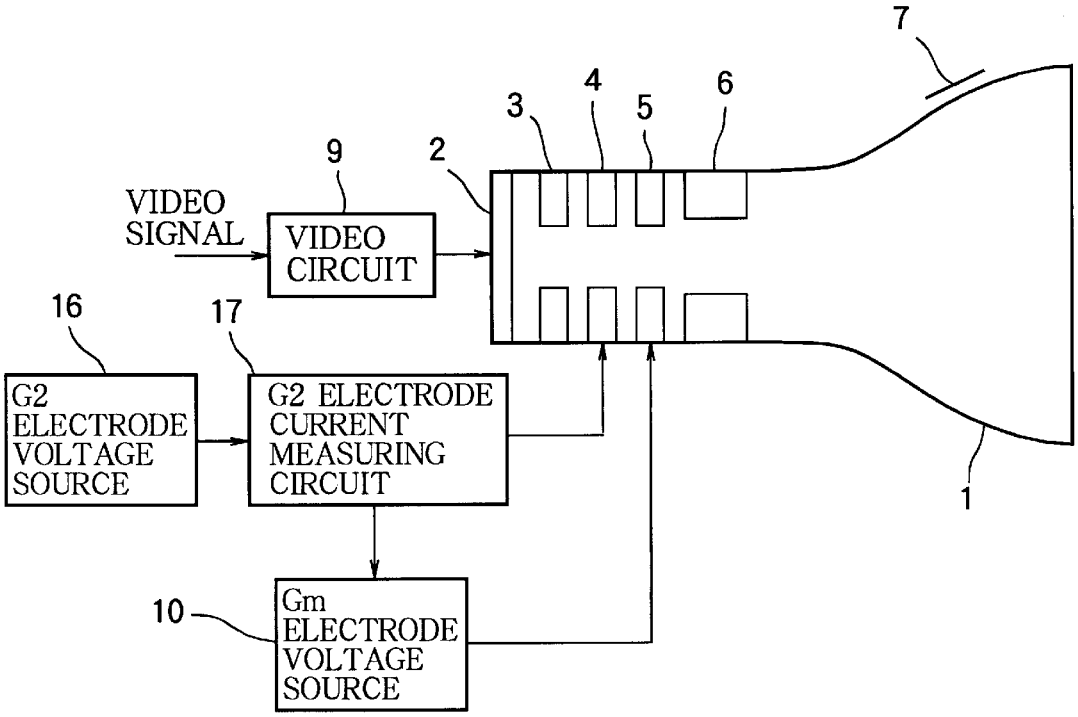
FIG. 8 is a block diagram showing a structure of an eighth example of the CRT display apparatus according to the invention.

FIG. 8 is a block diagram showing a structure of an eighth example of the CRT display apparatus according to the invention. In FIG. 8, reference numerals identical to those in FIGS. 1 to 7 represent the same elements. As already described above, in the Hi-Gm tube, as the cathode voltage decreases, the G2 electrode current increases along with the beam current. In the eighth example as well as the fifth and sixth examples, the beam current is determined by measuring the G2 electrode current utilizing this characteristic. However, the eighth example differs from the fifth and sixth examples in that the output of the G2 electrode current measuring circuit 17 is supplied to the Gm electrode voltage source 10.

The Gm electrode voltage source 10, which produces a voltage to be applied to the Gm electrode, is capable of varying its output voltage according to the output of the G2 electrode current measuring circuit 17. When the measured G2 electrode current exceeds an allowable level, the Gm electrode voltage source 10 reduces its output voltage, i.e., the voltage applied to the Gm electrode 5, according to the measured value.

As already described above, the voltage of the Gm electrode 5 defines a threshold point with respect to the cathode voltage at which the screen starts to illuminate. When the cathode voltage falls below the voltage of the Gm electrode, the electron beam starts to flow to the screen, causing the screen to illuminate. Accordingly, if the Gm electrode voltage is lowered, the threshold point with respect to the cathode voltage at which the screen starts to illuminate is lowered, thereby enabling suppressing the beam current. Thus, it is possible to prevent the beam current from becoming excessive by controlling the voltage applied to the Gm electrode according to the value of the current flowing through the G2 electrode.

The above explained preferred embodiments are exemplary of the invention of the present application which is described solely by the claims appended below. It should be understood that modifications of the preferred embodiments may be made as would occur to one of skill in the art.

What is claimed is:

1. A CRT display apparatus including a CRT having an electron gun, said electron gun including:

a cathode;

a G1 electrode, a G2 electrode, and a G3 electrode disposed in that order for drawing electrons form said cathode; and a modulating Gm electrode disposed between said G2 electrode and said G3 electrode;

said CRT display apparatus further including:

a current measuring circuit for measuring one of a current flowing through said Gm electrode, a current flowing through said G2 electrode and a current flowing through an anode of said CRT; and a controller for controlling a value of a voltage applied to said Gm electrode according to a value of said current measured by said current measuring circuit.

2. A CRT display apparatus including a CRT having an electron gun, said electron gun including:

a cathode;

a G1 electrode, a G2 electrode, and a G3 electrode disposed in that order for drawing electrons form said cathode; and a modulating Gm electrode disposed between said G2 electrode and said G3 electrode;

said CRT display apparatus further including:

a current measuring circuit for measuring one of a current flowing through said Gm electrode, a current flowing through said G2 electrode and a current flowing through an anode of said CRT; and a controller for controlling a value of a voltage applied to said G2 electrode according to a value of said current measured by said current measuring circuit.

3. A CRT display apparatus including a video circuit and a CRT having an electron gun, said electron gun including:

a cathode;

a G1 electrode, a G2 electrode, and a G3 electrode disposed in that order for drawing electrons form said cathode; and a modulating Gm electrode disposed between said G2 electrode and said G3 electrode;

said video circuit supplying a video signal having an amplitude determined by a control signal to said cathode, said CRT display apparatus further including:

a current measuring circuit for measuring a value of one of a current flowing through said Gm electrode, a current flowing through said G2 electrode and a current flowing through an anode of said CRT, and supplying said measured value to said video circuit as said control signal.

* * * * *